US010533421B2

(12) United States Patent
Ramesh et al.

(10) Patent No.: US 10,533,421 B2
(45) Date of Patent: Jan. 14, 2020

(54) STEAM TURBINE ROTOR

(71) Applicant: General Electric Technology GmbH, Baden (CH)

(72) Inventors: Mageshwaran Ramesh, Zürich (CH); Thomas Schreier, Neuenhof (CH); Ingo Kuehn, Wettingen (CH); Gregoire Etienne Witz, Birmenstorf (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 460 days.

(21) Appl. No.: 14/925,021

(22) Filed: Oct. 28, 2015

(65) Prior Publication Data

US 2016/0123151 A1 May 5, 2016

(30) Foreign Application Priority Data

Oct. 29, 2014 (EP) ..... 14190785

(51) Int. Cl.
*F01D 5/06* (2006.01)
*F01D 5/08* (2006.01)

(52) U.S. Cl.
CPC ..... *F01D 5/08* (2013.01)

(58) Field of Classification Search
CPC ..... F01D 5/08; F01D 5/06; F05D 2300/611; F05D 2220/31
See application file for complete search history.

(56) References Cited

U.S. PATENT DOCUMENTS 7,614,849 B2 * 11/2009 Schmitz ..... C23C 28/347 415/200
8,047,775 B2 * 11/2011 Barnikel ..... C23C 4/02 415/200
8,128,341 B2 * 3/2012 Wieghardt ..... F01D 3/04 415/106
8,202,037 B2 * 6/2012 Deidewig ..... F01D 3/04 415/1
8,684,663 B2 * 4/2014 Bekyigit ..... F01D 3/04 415/115
2002/0102360 A1 * 8/2002 Subramanian ..... C23C 24/04 427/419.1
2007/0140840 A1 * 6/2007 Schmitz ..... C23C 28/347 415/200
2008/0213085 A1 * 9/2008 Deidewig ..... F01D 3/04 415/104
2009/0053069 A1 * 2/2009 Barnikel ..... C23C 4/02 416/241 R (Continued)

FOREIGN PATENT DOCUMENTS

EP 1 898 048 A1 3/2008
EP 2 031 183 A1 3/2009
EP 2 143 884 A1 1/2010

*Primary Examiner* — Eldon T Brockman
(74) *Attorney, Agent, or Firm* — Grogan, Tuccillo & Vanderleeden, LLP

(57) ABSTRACT

The invention relates to a steam turbine rotor wherein the inter blade region rotor surface, the feed region rotor surface, the piston region rotor surface and the stress relief groove rotor surface of the rotor are configured and arranged as steam exposed surfaces during normal operation of the steam turbine rotor. The steam turbine rotor has a thermal barrier coating on at least the piston region rotor surface.

7 Claims, 2 Drawing Sheets

(56) References Cited

U.S. PATENT DOCUMENTS

| | | | | |
|---|---|---|---|---|
| 2009/0185895 | A1* | 7/2009 | Wieghardt | F01D 3/04 415/104 |
| 2009/0185985 | A1 | 7/2009 | Strassburger | |
| 2009/0232646 | A1* | 9/2009 | Schmitz | C23C 28/347 415/177 |
| 2011/0103970 | A1* | 5/2011 | Bekyigit | F01D 3/04 416/96 R |
| 2014/0150431 | A1* | 6/2014 | Glos | F01D 5/28 60/670 |

* cited by examiner

STEAM TURBINE ROTOR

CROSS-REFERENCE TO RELATED APPLICATIONS

This application claims priority to European Patent application 14190785.7 filed Oct. 29, 2014, the contents of which are hereby incorporated in its entirety.

TECHNICAL FIELD

The present disclosure relates generally to rotors for steam turbines and more specifically to rotor configurations that improve low cycle fatigue of such rotors.

BACKGROUND

A steam turbine, as described in US patent application no. 2011/0103970A1, may comprises a rotor with an stress relief piston comprising a relief groove for relieving thermal stress that is outside the region of the live steam flow path that is displaced axial opposite the direction of the operating steam flow through the blade flow path.

With the increased use of renewable power there is an increased need for electric network operation to operate with increased cycling. This increase in operational flexibility may typically be limited by the steam turbine life as increased exposure to frequent thermal transient's increase the risk of the occurrence of thermal fatigue crack initiation during cold, warm and hot start-ups as well as during shutdowns. While this problem may be partially addressed through high quality rotor forgings that improved toughness and ductility, however, these measures do not overcome the negative effects thermal transients have on low cycle fatigue life of the rotor.

An additional problem is that in steam turbines having steam turbines, for example a high pressure turbine and an intermediate pressure turbine, different thermal conditions in each of the steam turbines results in different low cycle fatigue life of rotor portions of each of the steam turbines. The result can be unsynchronised maintenance schedule requirements of each of the steam turbines which may result an increase in maintenance outages. Although it may be possible to balance the low cycle fatigue life of rotor portions by the selection of rotor materials, there are practical limitations on achieving the objections by with rotor material selection alone.

There is therefore a need to both improve the low cycle fatigue life of steam turbine rotor portions as well as tailor the low cycle fatigue life of different portions to synchronise rotor portion maintenance cycles.

SUMMARY

A steam turbine rotor is disclosed that can at least partially address the negative effect of thermal transients on rotor life.

One general aspect includes a steam turbine rotor comprising, a inter blade region rotor surface having a plurality of axially arranged blade grooves therethrough for retaining a blade root, a feed region rotor surface adjacent the inter blade region rotor surface extending from an upstream blade groove, a piston region rotor surface adjacent the feed region rotor surface such that the feed region rotor surface is between the inter blade region rotor surface and the piston region rotor surface. The steam turbine rotor also includes a stress relief groove rotor surface extending through the piston region rotor surface. The inter blade region rotor surface, the feed region rotor surface, the piston region rotor surface and the stress relief groove rotor surface are configured and arranged as steam exposed surfaces during normal operation of the steam turbine rotor. A thermal barrier coating extends on at least the piston region rotor surface.

Further aspects may include one or more of the following features. A thermal barrier coating on the feed region rotor surface. A thermal barrier coating on the inter blade region rotor surface. The steam turbine rotor wherein the feed region rotor surface defines a radial-axial steam feed region. A thermal barrier coating on the piston region rotor surface. The steam turbine rotor configured as an intermediate pressure steam turbine rotor, a high pressure steam turbine rotor or a high pressure steam turbine rotor and an intermediate pressure steam turbine rotor. The radial thickness of the thermal barrier coating configured such that a low cycle fatigue resistance of the high pressure steam turbine rotor is similar to a low cycle fatigue resistance of the intermediate pressure steam turbine rotor.

It is a further object of the invention to overcome or at least ameliorate the disadvantages and shortcomings of the prior art or provide a useful alternative.

Other aspects and advantages of the present disclosure will become apparent from the following description, taken in connection with the accompanying drawings which by way of example illustrate exemplary embodiments of the present invention.

BRIEF DESCRIPTION OF THE DRAWINGS

By way of example, an embodiment of the present disclosure is described more fully hereinafter with reference to the accompanying drawings, in which.

DETAILED DESCRIPTION

Figure 1:
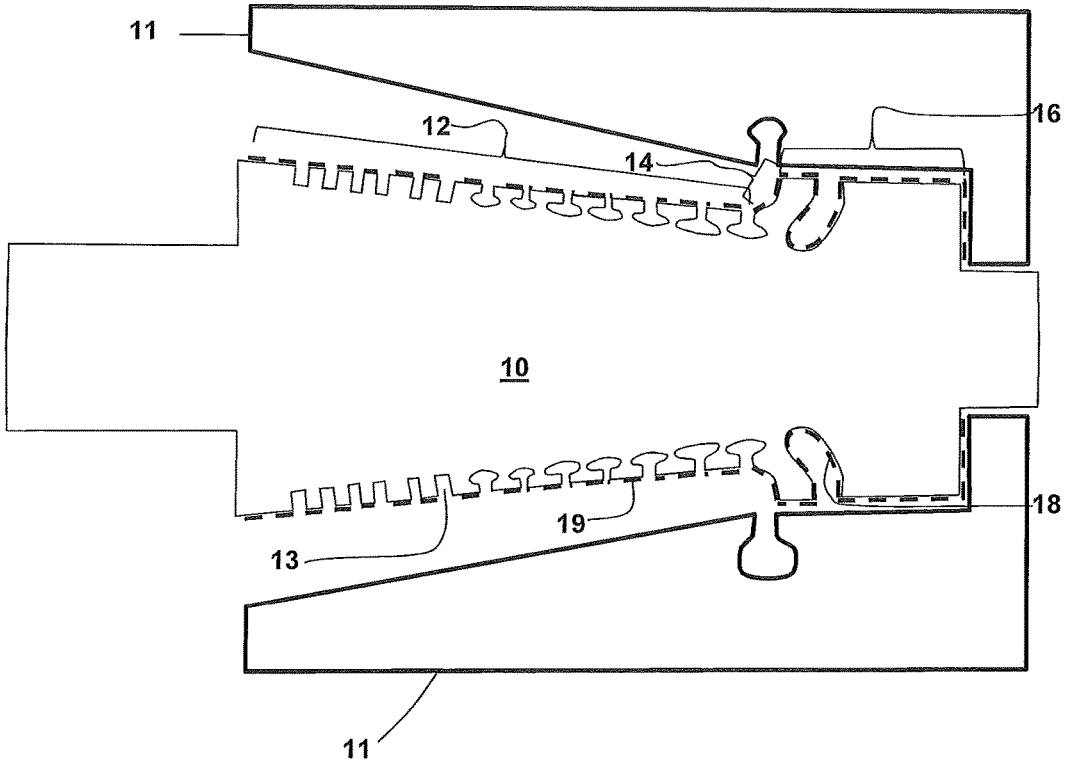
FIG. 1 is a sectional view of a high pressure steam turbine rotor with a thermal barrier coating according to an exemplary embodiment of the disclosure.

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiment disclosed herein.

An exemplary embodiment of a High Pressure steam turbine rotor 10 typically contained in an inner casing 11 is shown in FIG. 1. The High Pressure steam turbine rotor 10 comprises a inter blade region rotor surface 12, a feed region rotor surface 14, and a piston region rotor surface 16.

The inter blade region rotor surface 12 is a region in which axial arranged rotating blades extend circumferentially around the High Pressure steam turbine rotor 10. These blades are attached to the High Pressure steam turbine rotor 10 by means of blade grooves 13 that extend through the inter blade region rotor surface 12. The inter blade region rotor surface 12 can therefore be defined as the surface region of the High Pressure steam turbine rotor 10 in which blade grooves 13 are located.

The feed region rotor surface 14 is a region upstream and immediately adjacent the inter blade region rotor surface 12. This region of the rotor is a region that in operation is exposed to steam as it is fed into the steam turbine. Typically, the region is shaped to direct radially fed steam into an axial direction by having a radial to axial transition surface that extends to the first upstream blade groove 13.

The piston region rotor surface 16 is located immediately adjacent the feed region rotor surface 14 such that the feed region rotor surface 14 is located between the piston region rotor surface 16 and the inter blade region rotor surface 12. The purpose of the piston region is to counteract end thrust of blading typical of reaction type steam turbines and thus produce a thrust of the rotor towards the high pressure end of the machine under all operation conditions. Pistons may be either integral with the solid rotor or shrunk and keyed into position.

In an exemplary embodiment, the piston region rotor surface 16 has a stress relief groove with an opening through the piston region rotor surface 16. The stress relief groove has a stress relief groove rotor surface 18.

In exemplary embodiments each of the inter blade region rotor surface 12, the feed region rotor surface 14, the piston region rotor surface 16 and/or the stress relief groove rotor surface 18 have a thermal barrier coating 19 on, that is bonded to, the respective surface. Each of the surfaces 12,14,16,18 with a thermal barrier coating 19 may have a thermal barrier coating 19 that either partially or fully covers the surface 12,14,16,18 wherein the radial thickness of the thermal barrier coating 19 may be either uniform or vary.

Preferably at least the stress relief groove rotor surface 18 has thermal barrier coating 19.

Figure 2:
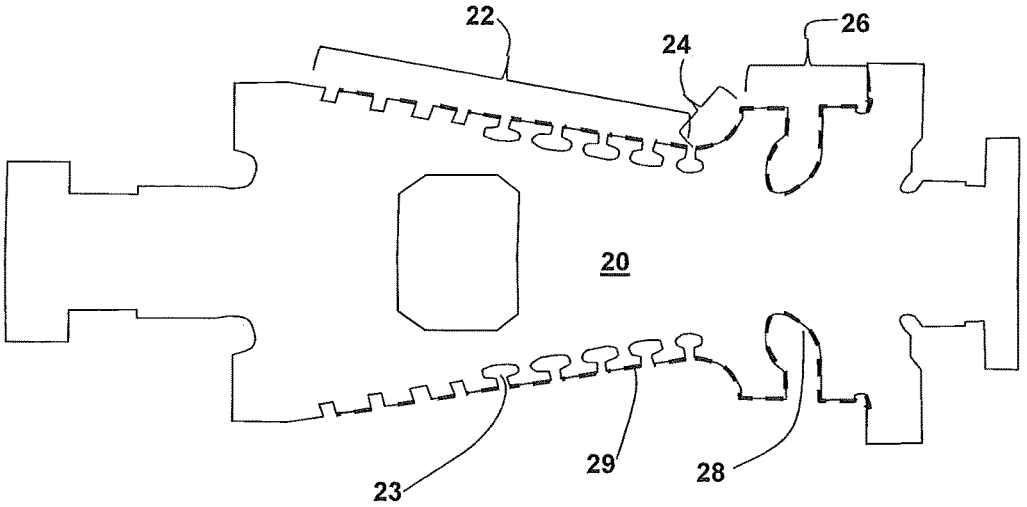
FIG. 2 is a sectional view of an intermediate pressure steam turbine rotor with a thermal barrier coating according to an exemplary embodiment of the disclosure.

An exemplary embodiment of an intermediate Pressure steam turbine rotor 20 shown in FIG. 2 comprises a inter blade region rotor surface 22, a feed region rotor surface 24, and a piston region rotor surface 26.

The inter blade region rotor surface 22 is a region axially between rotating blades that are circumferentially distributed on the Intermediate Pressure steam turbine rotor 20 by means of that extend through the rotor surface.

The feed region rotor surface 24 is a region upstream and immediately adjacent the inter blade region rotor surface 22. This region of the rotor is a region that in operation is exposed to steam as it is fed into the steam turbine. Typically, the region is shaped to direct radially fed steam into an axial direction by having a radial to axial transition surface that extends to the first upstream blade groove 23.

The piston region rotor surface 26 is located immediately adjacent the feed region rotor surface 24 such that the feed region rotor surface 24 is located between the piston region rotor surface 26 and the inter blade region rotor surface 22. The purpose of the piston region is to counteract end thrust of blading typical in single flow reaction type steam turbines and thus produce a thrust of the rotor towards the high pressure end of the machine under all operation conditions. Pistons may be either integral with the solid rotor or shrunk and keyed into position.

In an exemplary embodiment, the piston region rotor surface 26 has a stress relief groove with an opening through the piston region rotor surface 26. The stress relief groove has a stress relief groove rotor surface 28.

In exemplary embodiments each of the inter blade region rotor surface 22, the feed region rotor surface 24, the piston region rotor surface 26 and/or the stress relief groove rotor surface 28 have a thermal barrier coating 29 on, that is bonded to, the respective surface. Each of the surfaces 22, 24, 26, 28 with a thermal barrier coating 29 may have a thermal barrier coating 29 that either partially or fully covers the surface 22, 24, 26, 28 wherein the radial thickness of the thermal barrier coating 29 may be either uniform or variable.

In an exemplary embodiment only the stress relief groove rotor surface 28 has thermal barrier coating 29.

Figure 3:
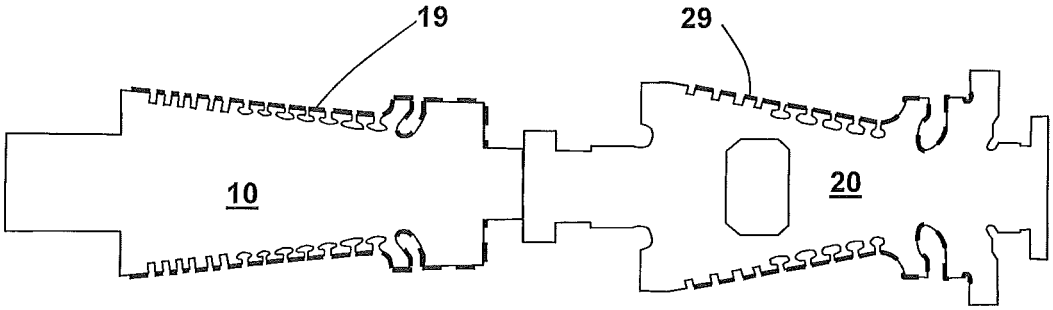
FIG. 3 is a section view of a combined high pressure steam turbine rotor and an intermediate pressure steam turbine rotor having a thermal barrier coating according to FIGS. 1 and 2.

An exemplary embodiment shown in FIG. 3 is a steam turbine rotor comprising a High Pressure steam turbine rotor 10 and an Intermediate Pressure steam turbine rotor 20. The radial thickness of thermal barrier coatings 29 of rotor surfaces 12, 14, 16, 18, 22, 24, 26, 28 of both the High Pressure steam turbine rotor 10 and Intermediate Pressure steam turbine rotor 20 described in various exemplary embodiments, are configured so that the low cycle fatigue resistance of the high pressure steam turbine rotor portion is similar to the low cycle fatigue resistance of the intermediate pressure steam turbine based on the expected working conditions of the rotor 10, 20. In the exemplary embodiment, the rotor 10, 20 may be a single rotor 10, 20 or else a joined rotor 10, 20, joined, for example, by flanges, a coupling or a clutch.

Although the disclosure has been herein shown and described in what is conceived to be the most practical exemplary embodiment, the present disclosure can be embodied in other specific forms. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

The invention claimed is:

1. A steam turbine rotor comprising:

a rotor, the rotor comprising a plurality of axially arranged blade grooves therethrough for retaining a blade root;

an inter blade region rotor surface, located axially between each blade groove;

a feed region rotor surface adjoining the inter blade region rotor surface and extending from an upstream blade groove; and a piston region rotor surface adjoining the feed region rotor surface, such that the feed region rotor surface is located between the inter blade region rotor surface and the piston region rotor surface; the piston region rotor surface further comprising an opening and a stress relief groove, the stress relief groove comprising a stress relief groove surface;

wherein each of the inter blade region rotor surface, the feed region rotor surface and the piston region rotor surface are configured to be exposed to steam during normal operation of the steam turbine rotor; and wherein each of the piston region rotor surface, the feed region rotor surface, the stress relief groove surface and at least a portion of the inter blade region rotor surface has a thermal barrier coating bonded to each respective surface that either partially or fully covers the surface.

2. The steam turbine rotor of claim 1, wherein the feed region rotor surface defines a radial-axial steam feed region.

3. The steam turbine rotor of claim 1, configured as an intermediate pressure steam turbine rotor.

4. The steam turbine rotor of claim 1, configured as a high pressure steam turbine rotor.

5. The steam turbine rotor of claim 1, configured as a high pressure steam turbine rotor and an intermediate pressure steam turbine rotor.

6. The steam turbine rotor of claim 5, wherein a radial thickness of the thermal barrier coating of the high pressure steam turbine rotor is greater than a radial thickness of the thermal barrier coating of the intermediate pressure steam turbine rotor.

7. A steam turbine rotor comprising:

a rotor comprising a plurality of axially arranged blade grooves for retaining a blade root;

an inter blade region rotor surface located axially between each blade groove;

a feed region rotor surface located adjacent to the inter blade region rotor surface and extending from an upstream blade groove; and a piston region rotor surface located adjacent to the feed region rotor surface such that the feed region rotor surface is located between the inter blade region rotor surface and the piston region rotor surface, the piston region rotor surface further comprising an opening and a stress relief groove, the stress relief groove comprising a stress relief groove surface;

wherein:

each of the inter blade region rotor surface, the feed region rotor surface and the piston region rotor surface are configured to be exposed to steam during normal operation of the steam turbine rotor;

each of the piston region rotor surface, the feed region rotor surface, the stress relief groove surface and at least a portion of the inter blade region rotor surface has a thermal barrier coating bonded to each respective surface that either partially or fully covers the surface; and a radial thickness of the thermal barrier coating varies across one or more of the piston region rotor surface, the feed region rotor surface, the stress relief groove surface and the portion of the inter blade region rotor surface.

* * * * *